US008772658B2

(12) United States Patent
Chu

(10) Patent No.: US 8,772,658 B2
(45) Date of Patent: Jul. 8, 2014

(54) ELECTRICALLY CONDUCTIVE STRUCTURE OF MICRO SWITCH

(76) Inventor: Ching-Hsiung Chu, New Taipei (TW)

( * ) Notice: Subject to any disclaimer, the term of this patent is extended or adjusted under 35 U.S.C. 154(b) by 229 days.

(21) Appl. No.: 13/288,043

(22) Filed: Nov. 3, 2011

(65) Prior Publication Data

US 2013/0112535 A1 May 9, 2013

(51) Int. Cl.
*H01H 1/52* (2006.01)

(52) U.S. Cl.
USPC ..... 200/314; 200/302.2

(58) Field of Classification Search
USPC ..... 200/314, 313, 31, 317, 320, 302.2, 200/302.3, 341, 345, 5, 513; 362/23.03, 362/23.05, 23.07, 23.1, 23.13, 23.14, 23.16
See application file for complete search history.

(56) References Cited

U.S. PATENT DOCUMENTS 3,723,684 A * 3/1973 Greenwood ..... 200/83 R
3,879,586 A * 4/1975 DuRocher et al. ..... 200/5 A
4,659,881 A * 4/1987 Dowe ..... 200/5 R
4,673,780 A * 6/1987 Kenway ..... 200/302.2
4,897,516 A * 1/1990 Wakatsuki ..... 200/302.2
5,144,103 A * 9/1992 Suwa ..... 200/344
5,194,703 A * 3/1993 Deeg ..... 200/5 A
5,247,143 A * 9/1993 Suwa ..... 200/517
5,345,051 A * 9/1994 Miike ..... 200/345
5,939,690 A * 8/1999 Yasui et al. ..... 200/302.2
7,667,152 B2 * 2/2010 Su ..... 200/314
2005/0168966 A1 * 8/2005 Maeda et al. ..... 362/23

* cited by examiner

*Primary Examiner* — Renee S Luebke
*Assistant Examiner* — Harshad Patel

(57) ABSTRACT

An electrically conductive structure of a micro switch capable of letting users know about the reciprocal movement of a switch button, comprising a base, having an electrode module installed in a containing groove formed at the top of the base; an axis cylinder slidably installed in the containing groove; a conical sleeve made of a soft high temperature resisting material and disposed between the axis cylinder and the electrode module; a metal conductive bump formed at the top of the conical sleeve and driven by the axis cylinder to compress and release the conical sleeve to connect and disconnect the electrode module, and the axis cylinder moves reciprocally to produce a hand-pressing feeling, and the containing groove has as sheathe made of a soft high temperature resisting material to block external liquid from entering into the containing groove to improve the service life of the switch.

5 Claims, 8 Drawing Sheets

(B-B)

ELECTRICALLY CONDUCTIVE STRUCTURE OF MICRO SWITCH

FIELD OF THE INVENTION

The present invention relates to an electrically conductive structure of a micro switch, in particular to the waterproof electrically conductive structure capable of letting users know about the reciprocal movement of a switch button, and the electrically conductive structure involves a containing groove of a base of the switch, internal and external electrode modules of the containing groove axis cylinder, and a waterproof sheath, particularly involves a conical sleeve and a conductive bump in the containing groove.

BACKGROUND OF THE INVENTION

Various types of electronic switches come with different sizes and specifications, the scope of applicability is very broad, and general precision equipments, small equipments or electric appliances usually use an electronic switch, and most electronic switches are smart switches, micro switches and touch switches. Since these types of switches have a light, thin, short and compact design, therefore they can be applied to electronic devices and instruments with a very limited space or having small or micro switches, such as the 3C electronic products or microcomputers.

In general, the convention micro switch comprises a plastic base, a movable shaft and a press button, and the base has a containing groove formed therein for installing an electrode module and an electrically conductive elastic plate, such that when the press button is touched to drive the movable shaft to press the electrically conductive elastic plate, the electrically conductive elastic plate will be twisted or distorted to touch positive and negative electrodes of an electrode module, so as to achieve the effect of turning on and off a power. The base generally has a plurality of electrically conductive terminals of the positive and negative electrodes at the bottom of the base, and the base can be installed onto a circuit board of the electronic device or instrument, and the electrically conductive terminal are soldered onto circuits on a surface of the circuit board by a solder paste.

The variable distance of the distortion and restoration of the conventional electrically conductive elastic plate is very short, so that the conductive elastic plate can be touched gently to turn on or off the switch. However, the micro switch adopting the electrically conductive elastic plate does not provide a noticeable means for users to notice the ON and OFF operation, and thus the micro switch adopting the electrically conductive elastic plate cannot be used as the press button of the electronic device or instrument that provides a way to let user know about the reciprocal movement of the switch.

In addition, the containing groove formed on the surface of the base of the conventional micro switch is opened to external atmosphere, so that moisture in the atmosphere or external liquid may enter into the containing groove along the movable shaft easily and affect the operation between the movable shaft, the electrode module and the electrically conductive elastic plate. As a result, the electrode module and the electrically conductive elastic plate may be rusted easily, and the switch may be damaged or may not be operated properly.

SUMMARY OF THE INVENTION

Therefore, it is a primary objective of the present invention to overcome the drawbacks of the prior art by provide an the waterproof electrically conductive structure capable of letting user know about the reciprocal movement of a switch button, since the conventional micro switch adopting the electrically conductive elastic plate does not provide a way to let users know about the status of turning on and off the switch, and the conventional micro switch has an interior exposed to the external atmosphere, so that moisture in the atmosphere or external liquid may enter into the switch to cause a poor operation or damage of the switch. The present invention can improve the durability and service life of the micro switch.

To achieve the aforementioned objective, the present invention provides an electrically conductive structure of a micro switch, comprising: a base, having a containing groove formed at the top of the base; an electrode module, installed at a groove bottom of the containing groove, and having a plurality of electrically conductive terminals extended to the bottom of the base; an axis cylinder, with a bottom end slidably disposed in the containing groove, and guided by an inner wall of the containing groove to approach or depart from the electrode module, and a top end of the axis cylinder being exposed from the top of the base; a conical sleeve with an upwardly tapered diameter, made of a soft high temperature resisting material, and disposed in the containing groove between the axis cylinder and the electrode module; and a conductive bump, made of metal, and disposed at the top of the conical sleeve, and driven by the axis cylinder to compress and release the conical sleeve, such that the conductive bump touches and detaches the electrode module to connect and disconnect the electrode module respectively, and a travel distance of the axis cylinder is defined between the conductive bump and the bottom of the conical sleeve and provided for a user's perception.

From the description above, the axis cylinder can produce a reciprocal movement with a travel distance through the conical sleeve to let users know about the status of the switch by touching, and the press feeling of the user's hand can be used as another option of using the micro switch.

In addition, the top of the base forms a peripheral surface at the external periphery of the containing groove, and the containing groove has a sheath made of a soft high temperature resisting material for covering the axis cylinder, and the external periphery of the sheath is extended to form a circular rib attached onto the peripheral surface for blocking external liquid from entering into the containing groove. Therefore, the containing groove is covered by the circular rib of the sheath to block external moisture or liquid from entering into containing groove, so as to prevent the electrode module and the conductive bump in the containing groove from being rusted.

The sheath can be transparent, and a transparent press button is installed at the top of the sheath. The sheath has an embedding groove formed at the bottom of the sheath and corresponding to the containing groove, and the top of the axis cylinder is embedded into the embedding groove. The circular rib has a ring slot formed around an external periphery of the containing groove, and a protruding ring is formed on the peripheral surface and embedded into the ring slot.

The base has two symmetrical outward hook portions formed at the external periphery of the base, and a ring element is sheathed on the periphery of the sheath, such that the circular rib is clamped between the ring element and the peripheral surface, and the ring element has two symmetrical first frame plates extended from the periphery of the ring element towards the outward hook portions, and the first frame plate has a slot portion formed thereon and latched to the outward hook portions. The ring element has two symmetrical second frame plates extended from the periphery of the ring element towards the base, and the base is positioned between the first frame plate and the second frame plate.

The containing groove has two symmetrical inward hook portions formed on an inner wall of the containing groove, and the axis cylinder has two symmetrical protrusions formed on an outer wall of the axis cylinder and stopped and blocked by the inward hook portions respectively.

The axis cylinder has a cylinder groove formed at the top of the axis cylinder, and the cylinder groove has a light emitting diode installed therein, and the light emitting diode has two pins extended to the bottom of the base. The axis cylinder has two symmetrical guide slots formed on an external periphery of the axis cylinder and interconnected to the cylinder groove, and the pins of the light emitting diode are passed through the guide slots respectively and extended to the bottom of the base.

DESCRIPTION OF THE PREFERRED EMBODIMENTS

Figure 1:
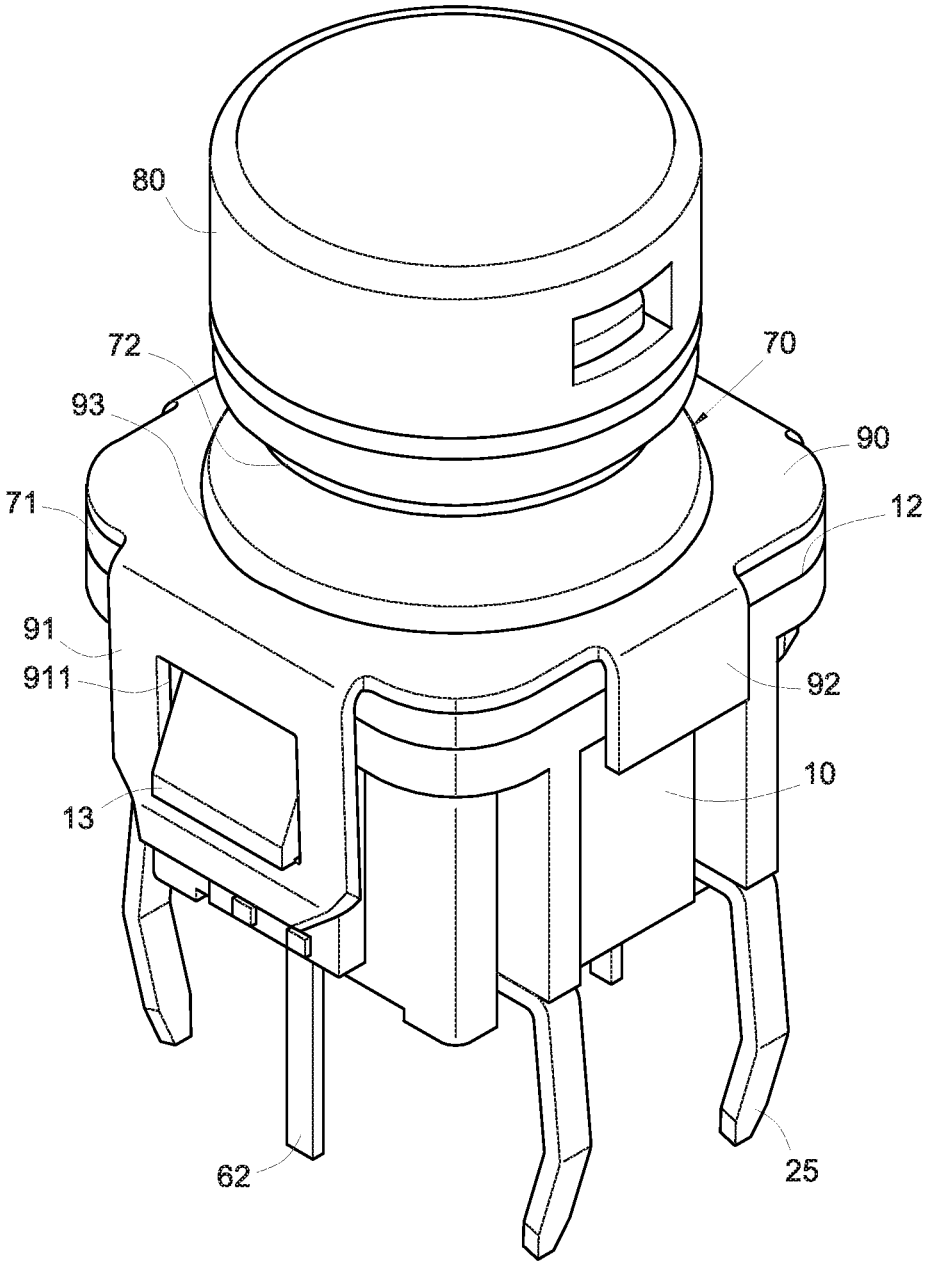
FIG. 1 is a perspective view of a preferred embodiment of the present invention.
Figure 2:
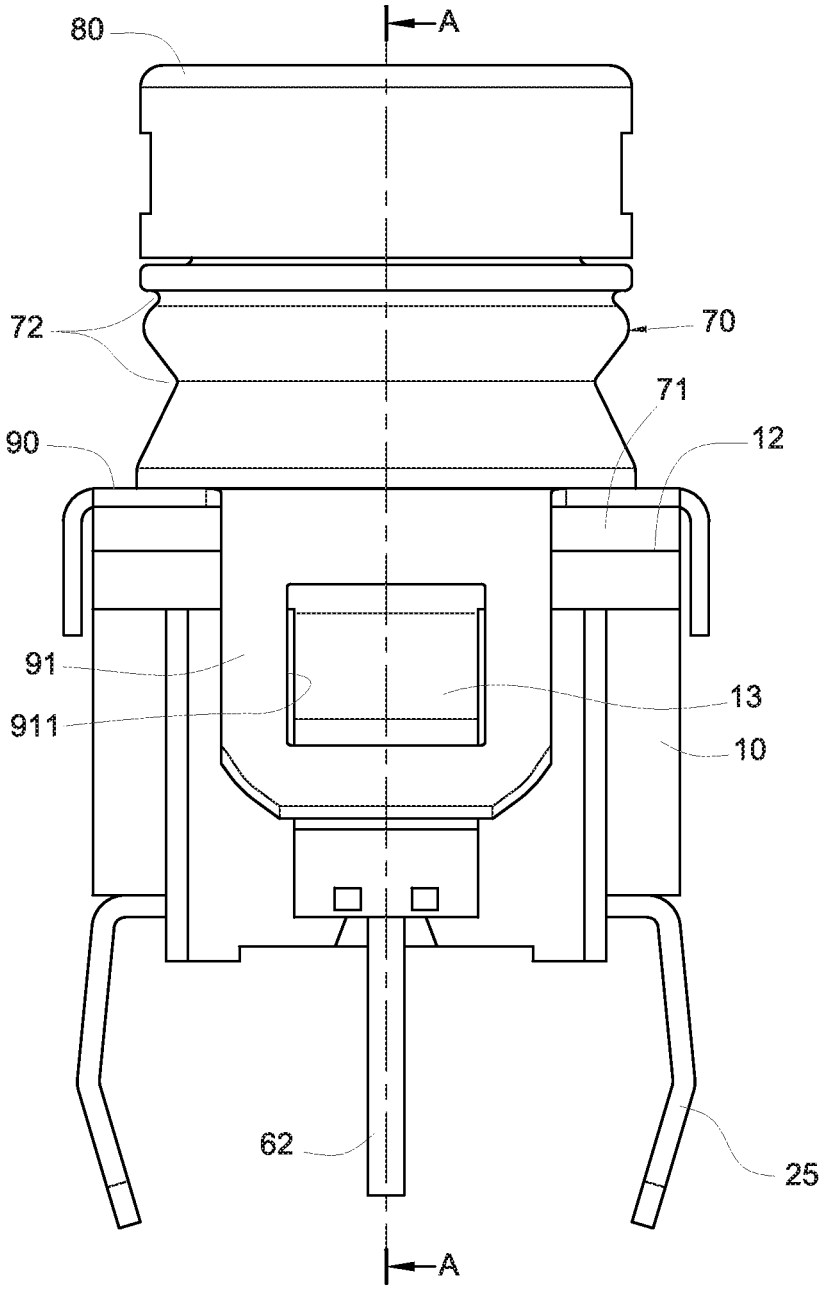
FIG. 2 is a front view of FIG. 1.
Figure 3:
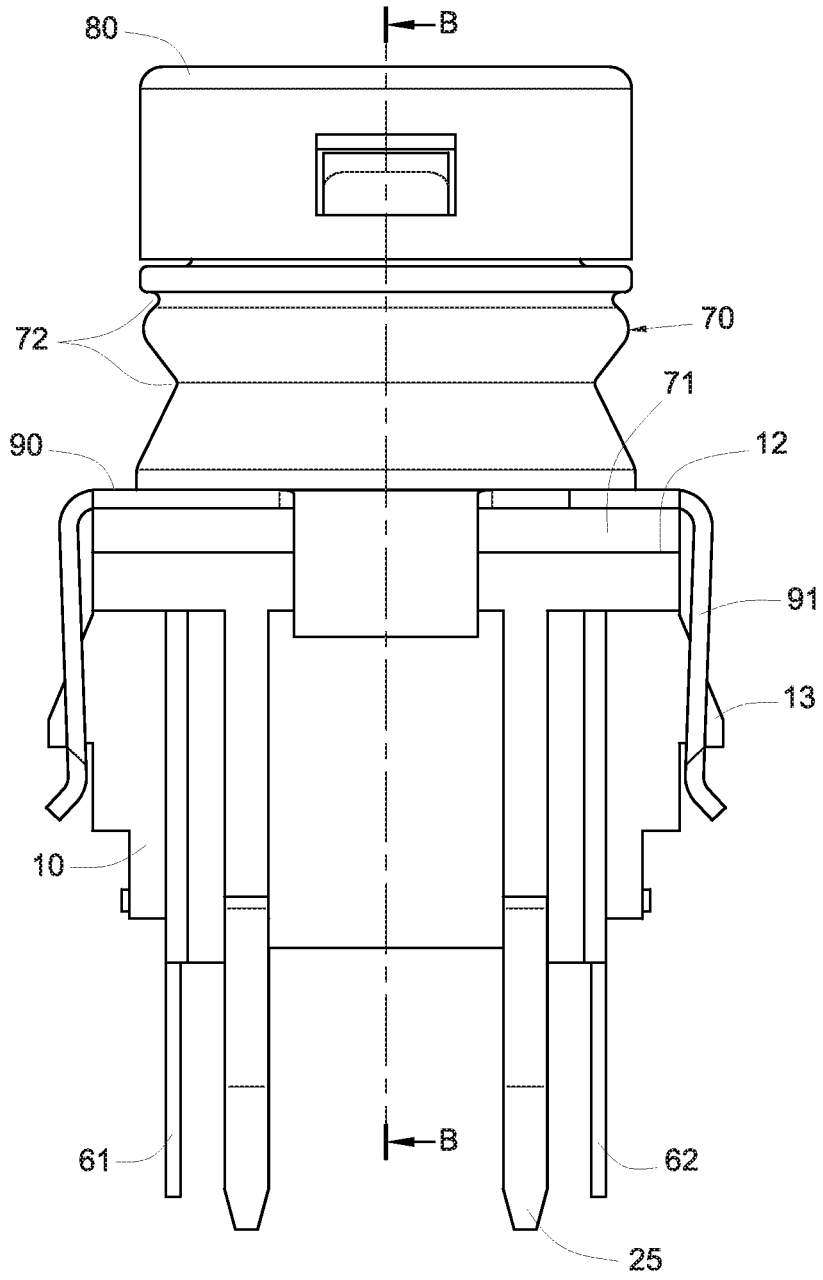
FIG. 3 is a left side view of FIG. 2.
Figure 4:
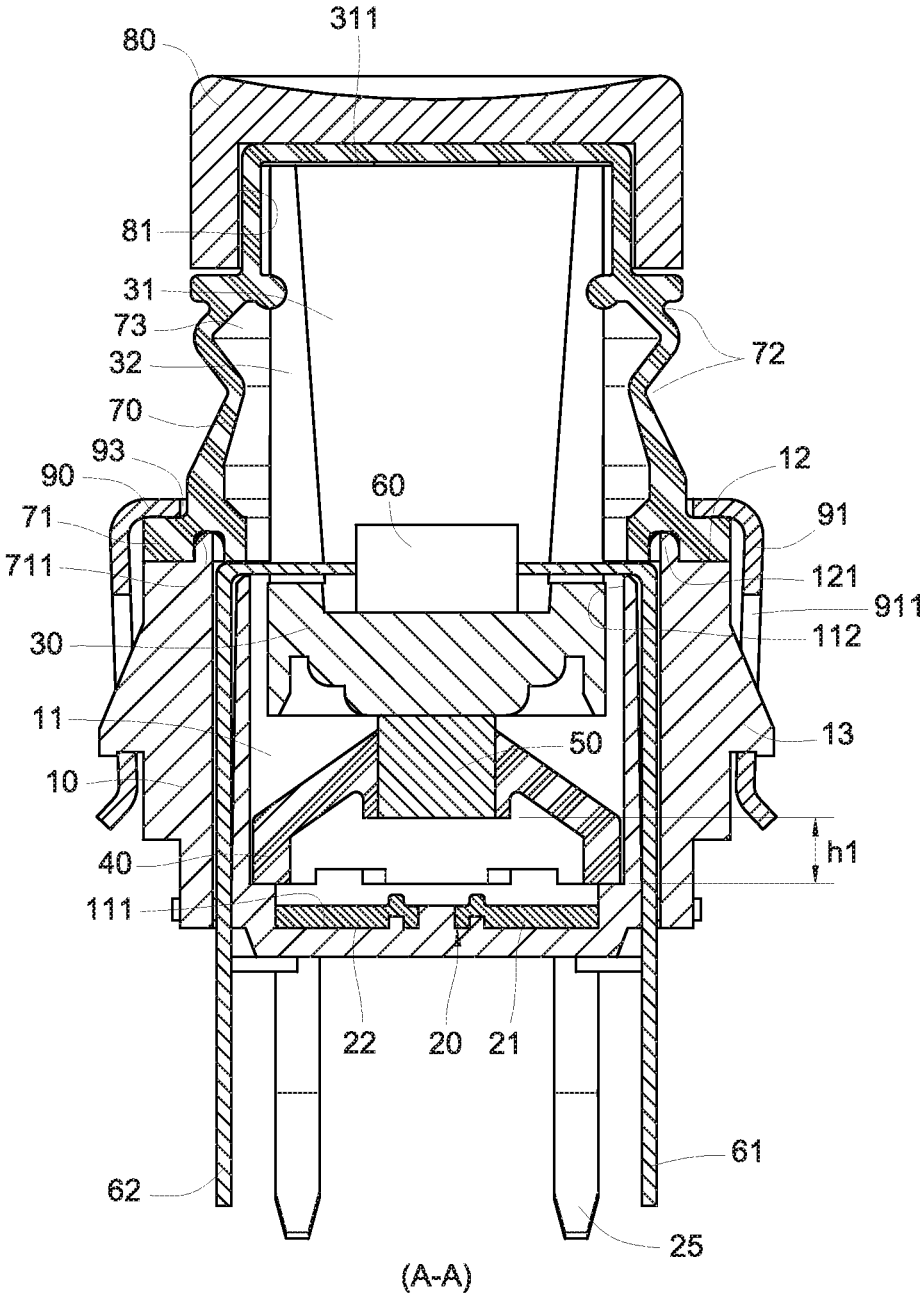
FIG. 4 is a cross-sectional view of Section A-A of FIG. 2.
Figure 5:
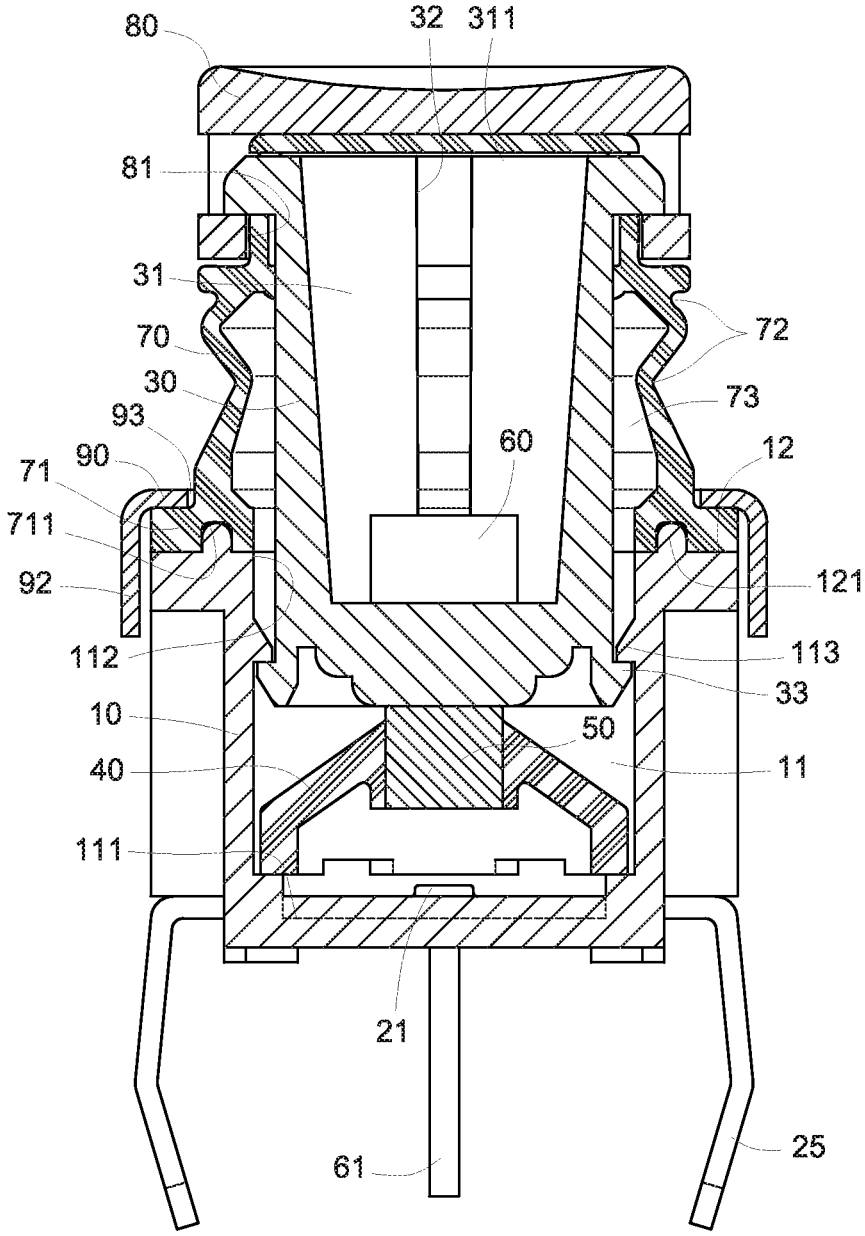
FIG. 5 is a cross-sectional view of Section B-B of FIG. 3.
Figure 6:
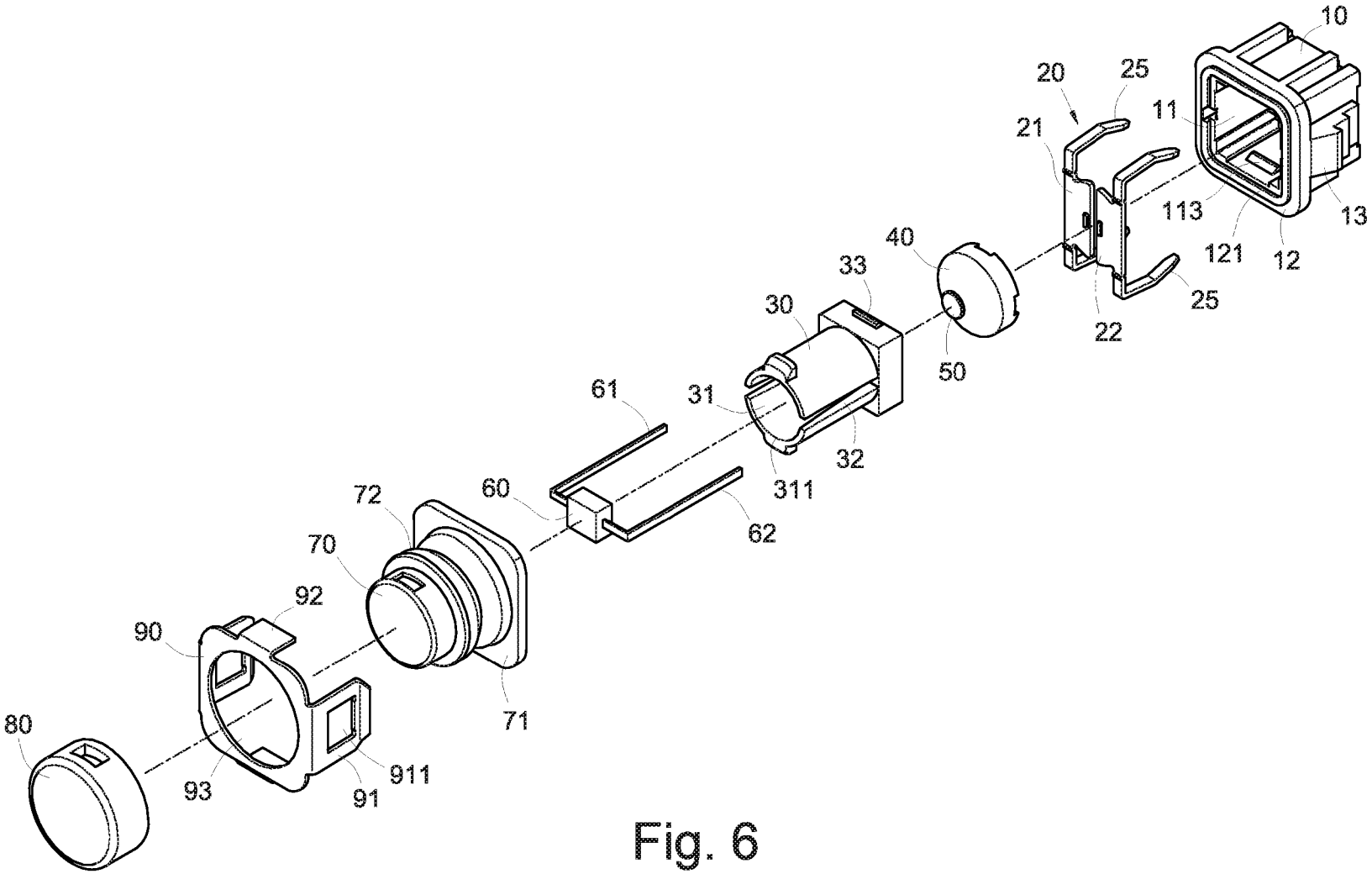
FIG. 6 is an exploded view of FIG. 1.
Figure 7:
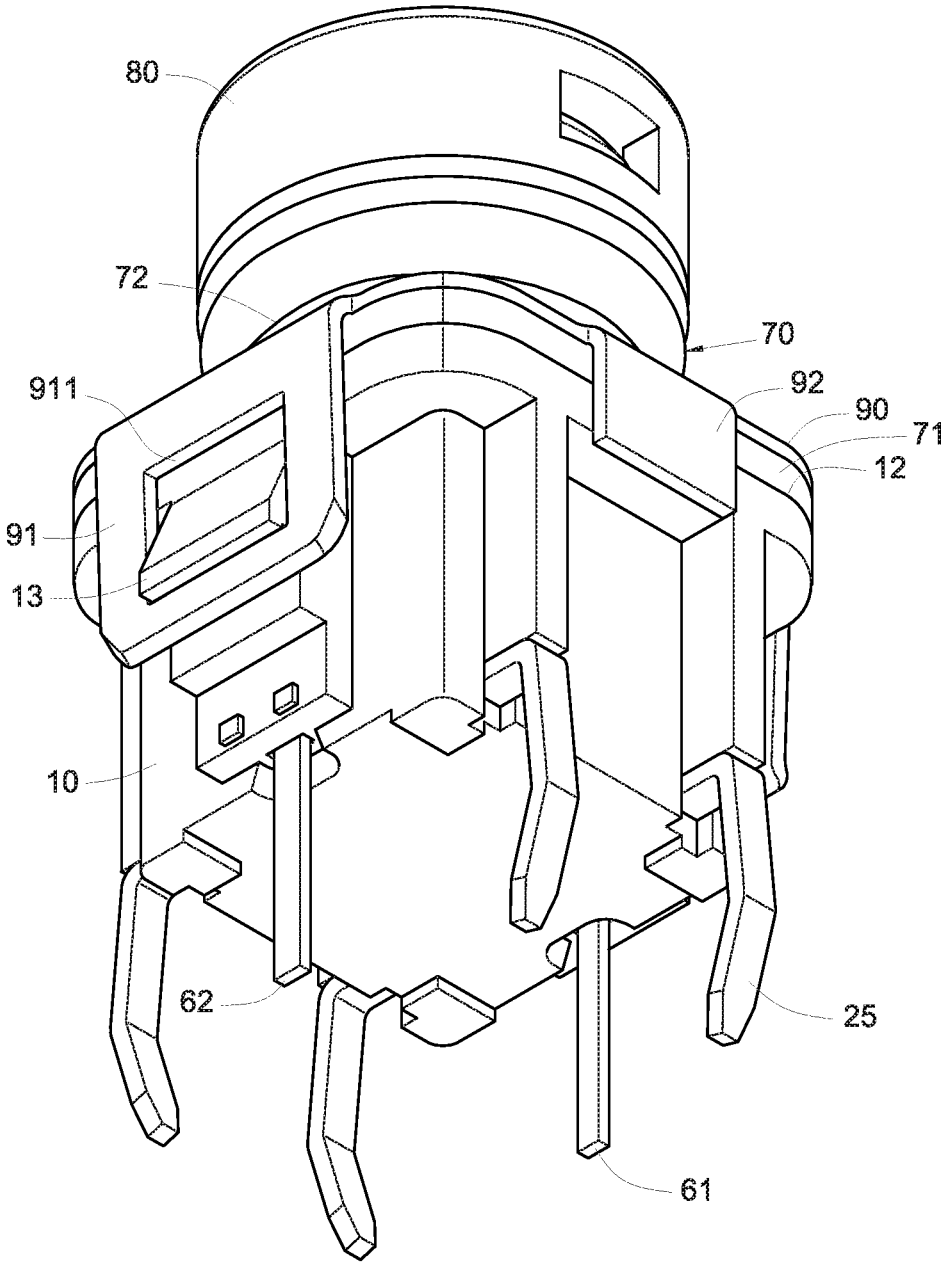
FIG. 7 is a bottom view of FIG. 1.

With reference to FIG. 1 for a perspective view of a preferred embodiment of the present invention and FIGS. 2 to 7 for an electrically conductive structure of a micro switch of the present invention, the electrically conductive structure comprises a rectangular base 10, an electrode module 20, an axis cylinder 30, a conical sleeve 40 with an upwardly tapered diameter and a conductive bump 50, wherein the base 10 has a containing groove 11 formed at the top of the base 10, and a peripheral surface 12 formed at the external periphery of the containing groove 11; the electrode module 20 is disposed at a groove bottom 111 at the bottom of the containing groove 11, and the electrode module 20 includes a positive electrode 21 and a negative electrode 22 with electrically conductive terminal 25 extended to the bottom of the base 10, and the electrically conductive terminal 25 are extended to both sides of the bottom of the base 10.

The bottom of the axis cylinder 30 is slidably disposed in the containing groove 11 and guided by an inner wall of containing groove 11 to approach and detach the electrode module 20 at the groove bottom 111 of the containing groove 11, and the top of the axis cylinder 30 is exposed from the containing groove 11 and disposed at the top of the base 10, and a cylinder groove 31 is formed at the top of the axis cylinder 30 and opened to the outside, and the top of the axis cylinder 30 can be pushed an external force to move the axis cylinder 30 towards the groove bottom 111.

The conical sleeve 40 is made of a soft high temperature resisting material and disposed in the containing groove 11 between the axis cylinder 30 and the electrode module 20. The conductive bump 50 is made of metal and disposed at the top of the conical sleeve 40, and the conical sleeve 40 can be elastically driven to move the conductive bump 50 upward, such that the conductive bump 50 pushes the bottom of the axis cylinder 30 to move towards a slot 112 at the top of the containing groove 11, and the conductive bump 50 can be driven by the bottom of the axis cylinder 30 to compress and release the conical sleeve 40, such that the conductive bump 50 can attach and detach the electrode module 20 to connect and disconnect the electrode module 20 respectively, and a travel distance h1 of the reciprocal movements of the axis cylinder 30 is defined between the bottom of the conductive bump 50 and the bottom of the conical sleeve 40 to let users know about the reciprocal movement of the axis cylinder 30, and the soft high temperature resisting material can be silicon.

The cylinder groove 31 includes a light emitting diode 60 installed therein, and the light emitting diode 60 has a positive pin 61 and a negative pin 62 extended to the bottom of the base 10, and the positive and negative pins 61, 62 are extended to both sides of the light emitting diode 60 respectively and disposed across symmetrical positions of the peripheral surface 12.

The containing groove 11 includes a sheath 70 made of a soft transparent high temperature resisting material for covering the axis cylinder 30, the cylinder groove 31 and the top of the light emitting diode 60, and a circular rib 71 is formed at the position proximate to the external periphery of the sheath 70 and attached to the peripheral surface 12 for blocking external liquid from entering into the containing groove 11, and the sheath 70 has a plurality of circular grooves 72 formed around the periphery of the sheath 70, and the circular grooves 72 are provided for compressing the sheath 70, and the soft transparent high temperature resisting material can be silicon.

The sheath 70 has an embedding groove 73 formed at the bottom of the sheath 70 and corresponding to the containing groove 11, and the top of the axis cylinder 30 is embedded in the embedding groove 73, and the top of the sheath 70 is sheathed with a square, polygonal or circular transparent press button 80, and a positioning groove 81 is formed at the bottom of the press button 80 for embedding the top of the sheath 70.

With the aforementioned components, the base 10 can be disposed on a surface of the circuit board, and the electrically conductive terminal 25 and the positive and negative pins 61, 62 are attached to the metal circuit on the surface of the circuit board, and then the circuit board is sent into a soldering furnace for a surface mount technology (SMT) operation, and the electrically conductive terminal 25 and the positive and negative pins 61, 62 are soldered onto the metal circuit on the surface of the circuit board.

Figure 8:
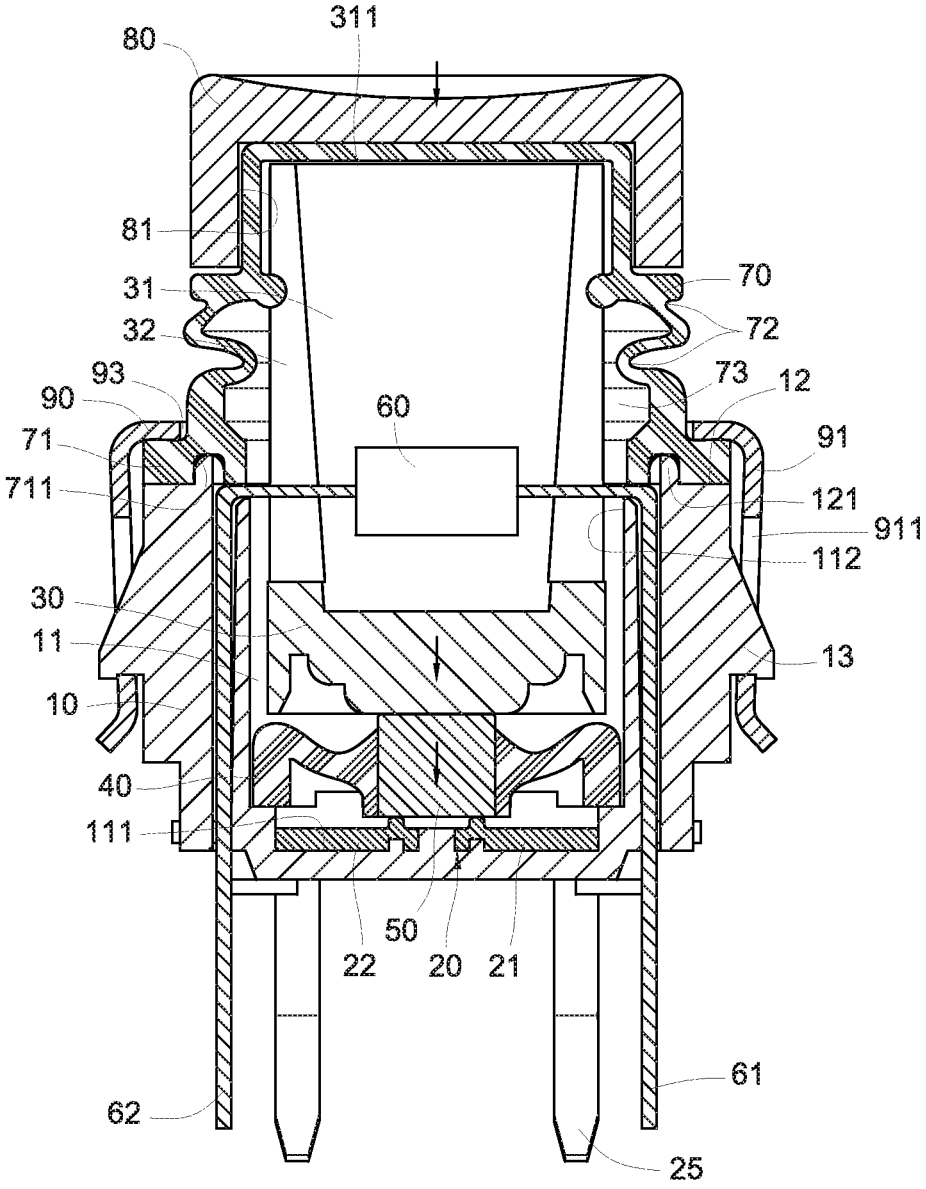
FIG. 8 is a cross-sectional view of a using status of FIG. 4.

In a general using condition, the sheath 70 and the conical sleeve 40 are flexible, so that when the top of the press button 80 is pressed by an external force (as shown in FIG. 8), the sheath 70 can be pressed downward and deformed to drive the axis cylinder 30 to move downward, and the bottom of the axis cylinder 30 pushes the conductive bump 50 to move through the travel distance h1 downward and touches the positive and negative electrodes 21, 22, so as to conduct the positive and negative electrodes 21, 22 with each other, and the metal circuit is conducted with the electrically conductive terminal 25 and the positive and negative electrodes 21, 22.

After the force exerting on the press button 80 and the axis cylinder 30 is released, the resilience of the conical sleeve 40 will drive the conductive bump 50, the axis cylinder 30 and the press button 80 to move through the travel distance h1 upward to resume their original position an disconnect the positive and negative electrodes 21, 22, such that the metal circuit will be situated at a disconnected state.

In the meantime, the light emitting diode 60 emits light when the positive and negative pins 61, 62 receive the power supplied by the metal circuit, and the light of the light emitting diode 60 can pass through the sheath 70 and the press button 80 to the outside to remind users about the position and using status of the switch.

It is noteworthy to point out that the circular rib 71 of the sheath 70 is covered onto the containing groove 11 to block external moisture or liquid from entering into the containing groove 11, and prevent the electrode module 20, the light emitting diode 60 and the conductive bump 50 in the containing groove 11 from being rusted.

Therefore, the present invention can use the light emitting diode 60 to produce a light source, and the axis cylinder 30 can produce a hand-feeling from the conical sleeve 40 to let users know about the reciprocal movements of the travel distance h1 and the hand press feeling can overcome the drawback of the prior art that the operation of turning on or off the micro switch adopting an electrically conductive elastic plate cannot be observed easily by users, and thus providing another option of using the micro switch. In the meantime, the sheath 70 is provided for covering the containing groove 11 to overcome the conventional switch with its interior opened to the external atmosphere, so that moisture in the atmosphere or external liquid may enter into the switch easily, thus causing a poor operation or a damage of the switch. The present invention can improve the service life of the switch.

Other implementations of the present invention are described as follows:

Two symmetrical hook portions 13 are disposed on an outer wall of the base 10, and a metal ring element 90 is sheathed on the external periphery of the sheath 70, such that the circular rib 71 at the outer wall of the sheath 70 is clamped between the ring element 90 and the peripheral surface 12, and two symmetrical first frame plate 91 are extended from the periphery of the ring element 90 towards the hook portion 13, and a slot portion 911 is formed on the first frame plate 91 to latch the hook portion 13, so that the ring element 90 can latch the sheath 70 to the top of the base 10 and securely clamp the circular rib 71 between the ring element 90 and the peripheral surface 12, and the ring element 90, the circular rib 71 and the peripheral surface 12 have a water-tight effect.

An opening 93 is formed at the center of the ring element 90 and sheathed on the external periphery of the sheath 70, and two symmetrical second frame plates 92 are extended from the periphery of the ring element 90 towards the base 10, and the wall of the base 10 is positioned between the first frame plate 91 and the second frame plate 92.

A ring slot 711 is formed at the bottom of the circular rib 71 and disposed around the external periphery of the containing groove 11, and a protruding ring 121 is formed on the peripheral surface 12 and embedded into the ring slot 711, so as to improve the water-tightness between the circular rib 71 and the peripheral surface 12.

Two symmetrical guide slots 32 are formed on the external periphery of the axis cylinder 30 and interconnected to the cylinder groove 31, and the guide slot 32 is extended and interconnected to a slot 311 formed at the top of the cylinder groove 31, and the positive and negative pins 61, 62 of the light emitting diode 60 are passed through the guide slots 32 respectively and extended to the bottom of the base 10. While the axis cylinder 30 is driven by an external force to move reciprocally, the guide slots 32 can dodge away from the positive and negative pins 61, 62.

Two symmetrical inward hook portion 113 are formed on an inner wall of the containing groove 11, and two symmetrical protrusions 33 are formed on an outer wall of the axis cylinder 30 and blocked by the inward hook portions 113 respectively, so that the inward hook portions 113 can limit the movement of the axis cylinder 30 within the containing groove 11.

In addition, the conical sleeve 40 and sheath 70 made of silicon have the high temperature resisting property, so that the conical sleeve 40 and sheath 70 can be put together with the axis cylinder 30 and the base 10 into the soldering furnace to simplify the manufacturing process.

In addition, the conical sleeve 40 and sheath 70 are flexible and capable of absorbing external impacts to improve the service life of the switch.

What is claimed is:

1. An electrically conductive structure of a micro switch, comprising:

a base, having a containing groove formed at the top of the base;

an electrode module, installed at a groove bottom of the containing groove, and having a plurality of electrically conductive terminals extended to the bottom of the base;

an axis cylinder, with a bottom end slidably disposed in the containing groove, and guided by an inner wall of the containing groove to approach or depart from the electrode module, and a top end of the axis cylinder being exposed from the top of the base;

a conical sleeve with an upwardly tapered diameter, made of a soft high temperature resisting material, and disposed in the containing groove between the axis cylinder and the electrode module; and a conductive bump, made of metal, and disposed at the top of the conical sleeve, and driven by the axis cylinder to compress and release the conical sleeve, such that the conductive bump touches and detaches the electrode module to connect and disconnect the electrode module respectively, and a travel distance of the axis cylinder is defined between the conductive bump and the bottom of the conical sleeve and provided for a user's perception;

wherein the top of the base forms a peripheral surface at the external periphery of the containing groove, and the containing groove has a sheath made of a soft high temperature resisting material for covering the axis cylinder, the external periphery of the sheath is extended to form a circular rib attached onto the peripheral surface for blocking external liquid from entering into the containing groove, the sheath has an embedding groove formed at the bottom of the sheath and corresponding to the containing groove, and the top of the axis cylinder is embedded into the embedding groove.

2. The electrically conductive structure of a micro switch as recited in claim 1, wherein the sheath is transparent, and a transparent press button is installed at the top of the sheath.

3. The electrically conductive structure of a micro switch as recited in claim 1, wherein the containing groove has two symmetrical inward hook portions formed on an inner wall of the containing groove, and the axis cylinder has two symmetrical protrusions formed on an outer wall of the axis cylinder and stopped and blocked by the inward hook portions respectively.

4. The electrically conductive structure of a micro switch as recited in claim 1, wherein the axis cylinder has a cylinder groove formed at the top of the axis cylinder, and the cylinder groove has a light emitting diode installed therein, and the light emitting diode has two pins extended to the bottom of the base.

5. The electrically conductive structure of a micro switch as recited in claim 4, wherein the axis cylinder has two symmetrical guide slots formed on an external periphery of the axis cylinder and interconnected to the cylinder groove, and the pins of the light emitting diode are passed through the guide slots respectively and extended to the bottom of the base.

* * * * *